United States Patent [19]

Guetta

[11] 3,984,674

[45] Oct. 5, 1976

[54] ILLUMINATED DECORATIVE ITEMS

[76] Inventor: Gilles Guetta, 81 Avenue du 11 Novembre, 94210 La Varenne St. Hilaire, France

[22] Filed: Jan. 21, 1975

[21] Appl. No.: 543,015

[30] Foreign Application Priority Data

Jan. 21, 1974 France ..... 74.01868

[52] U.S. Cl. ..... 240/6.4 W; 200/61.47; 200/224; 240/10 R; 339/11; 339/118 R

[51] Int. Cl.[2] ..... F21V 33/00

[58] Field of Search ..... 240/6.4 W, 6.4 R, 10 R; 339/11, 118 R; 200/189, 224, 61.47

[56] References Cited

UNITED STATES PATENTS

| | | | |
|---|---|---|---|
| 2,968,861 | 1/1961 | Bacus | 200/224 X |
| 3,304,651 | 2/1967 | Deyerl | 240/6.4 R |
| 3,383,503 | 5/1968 | Montgomery | 240/6.4 W |
| 3,508,041 | 4/1970 | Sweany et al. | 240/6.4 W |
| 3,521,049 | 7/1970 | Young | 240/6.4 W |
| 3,689,758 | 9/1972 | Power | 240/6.4 W |
| 3,737,647 | 6/1973 | Gomi | 240/6.4 W |
| 3,840,853 | 10/1974 | Cukale | 240/6.4 W |
| 3,866,035 | 2/1975 | Richey | 240/6.4 W |

*Primary Examiner*—R. L. Moses

[57] ABSTRACT

Apparatus for producing a variable illuminated display suitable for incorporation in articles of personal jewelry. The apparatus includes a switch device responsive to movements of an individual wearing the jewelry article for electrically energizing small light emitting devices singly or in groups.

11 Claims, 3 Drawing Figures

ILLUMINATED DECORATIVE ITEMS

BACKGROUND OF THE INVENTION

1. Field of the Invention

The present invention relates to decorative items and particularly to articles of jewelry which include an "active" display. More specifically, this invention is directed to devices, which may be included within jewelry items, for electrically producing a variable lighted display. The invention further includes means for storing and recharging the current source for the electrically energized decorative items. Accordingly, the general objects of the present invention are to provide novel and improved apparatus of such character.

2. Description of the Prior Art

Decorative jewelry items, and particularly clasps and bracelets, which include light sources are known in the art. Such prior art electrically operated active jewelry items are energized by batteries which are usually contained within the items. In order to achieve an attention getting effect, the light sources in prior art electrified jewelry items have consisted of small lamps connected in series with either bimetallic switch devices or coupled to RC circuits. These self-blinking lamps; i.e., the lamps which either include or are connected in series with bimetallic elements; require a relatively high voltage source. The electrified jewelry articles employing an RC circuit require a rather large size capacitance in order to obtain satisfactory operation from a relatively low potential source. In either event, an inordinate amount of space is required to produce the active light display and the power consumption of the display has been relatively high.

The above briefly discussed limitations have greatly limited the application of active electrical displays in the jewelry field. In the interest of conserving space and minimizing weight and taking into consideration the power requirements, prior jewelry items including flashing or blinking lights have included a very limited number of lamps; usually one or two.

SUMMARY OF THE INVENTION

The present invention overcomes the above briefly discussed and other deficiencies and disadvantages of the prior art by providing a novel and improved decorative article having an active display capable of operation from a battery source for long periods of time. Decorative articles in accordance with the present invention are characterized by a high degree of volumetric efficiency whereby the present invention is particularly well suited for use in jewelry items.

Jewelry items incorporating the present invention include a plurality of electrically stimulated light emitting devices, for example luminescent diodes,. positioned behind a face member. The light emitting devices used in the present invention will be characterized by very small size and low power consumption. The face member may be of open-worked construction or be partially transparent or partially translucent. A current distributor, hereinafter called a switching device, is electrically connected between the light emitting devices and a current source. In the preferred embodiment the switching device controls the delivery of current to a preselected light emitting device or devices as a function of the movements of the body of the individual carrying the jewlery item.

A switching device in accordance with the present invention may include a rotor controlled by movements of the article in which the invention is installed whereby a series of light emitting devices may be energized, either singly or in combinations, in a predetermined sequence. The present invention will, however, preferably include a switching device in the general form of a mercury switch. A preferred mercury switch for use in the invention includes a closed container having, on one internal surface thereof, a plurality of separated conductors. A first or common conductor will typically be connected to a first polarity terminal of the current source and the remaining conductors will be respectively connected to preselected light emitting devices; the light emitting devices in turn being connected to the second polarity terminal of the current source. A mass of liquid mercury is included within the container so as to establish an electrical circuit between the common conductor and one or more of the spaced conductors as a function of the position of the container with respect to the horizontal.

In accordance with a preferred embodiment the conductors of the switching device are in the form of a printed circuit having conductive segments or terminals arranged in a pattern of concentric circles; the conductive segments which are connected to the light emitting devices actually consisting, on the side which is connected by the liquid mercury, of spaced segments of concentric circles. A switching device of this type is quite compact and capable of being used to control the energization of a comparatively large number of luminous diodes. These advantageous results may be attributed to the fact that presently available manufacturing techniques permit the fabrication of printed circuits having a substantial number of closely spaced concentric annular conductors on a small surface. Additionally, the necessary height to allow the free movement of the mercury "wiper arm" of the switching device can be very small. A particularly advantageous feature of the mercury switching device resides in the fact that it does not itself consume any electric current since operation of the switch is brought about in response to movements of the individual wearing the article including the invention; i.e., the switching action is solely motion and attitude responsive. Thus, all of the current available from the power source may be utilized to produce light and a great number of individual luminescent diodes or groups of light emitting devices may be employed in the interest of producing very striking effects.

In accordance with a preferred embodiment of the invention the mercury switching device consists of a printed circuit having conductors on both sides of a substrate. The lower or outer face of the substrate; i.e., the face which is not in contact with the mercury; will carry concentric circular conductors. The opposite face of the board, which is contacted by the mercury "switch arm", carries conductor portions in the form of arcuate segments vertically aligned with the circular conductors. The segments and circular conductors are interconnected by means of appropriate through conductors in the printed circuit substrate.

Also in accordance with a preferred embodiment of the invention, the light emitting devices are mounted on and connected to a printed "branching" or distribution circuit which includes conductors on both sides of a substrate. The printed distribution circuit will typically comprise a first plurality of conductors on a first side of the substrate and a second plurality of conductors, which intersect vertical planes through conductors of the first plurality, disposed on the second side of the substrate. Each of the light emitting devices will be connected between a conductor on the first side of the substrate and a conductor on the second side of the substrate; insulated through holes being provided in the substrate to permit such connection and all of the light emitting devices being mounted at the same side of the printed circuit substrate. This arrangement, i.e., the "intersecting" conductors at two levels; affords the designer of the jewelry item great flexibility in achieving a desired effect and permits the same basic package to be employed in numerous articles merely by changing the point of connection of the light emitting devices; i.e., the apparatus is in essence programmable.

Also in accordance with a preferred embodiment of the invention the switching device and interconnection circuit for the light emitting devices are formed on a single flexible printed circuit board. This arrangement facilitates the manufacture and installation of the invention and permits the invention to take the shape of the decorative design or, in the case of a bracelet for example, the curvature of a person's arm.

The present invention may be powered by a conventional battery but preferably includes a rechargeable accumulator which may be connected to a receptacle provided in the bottom of the decorative article. When a rechargeable accumulator is employed the invention also includes a support on which the decorative article will be positioned during a recharging operation. Such a support will consist of a box which contains a source of charging current. This support box will be provided, in its upper surface, with a depression or well which receives the decorative article. The well will be provided, at the bottom, with a mate connector which engages the receptacle in the base of the decorative article whereby the charging operation will begin immediately and automatically upon placement of the decorative article on the support.

The present invention may also be provided with a disconnect switch whereby, regardless of the position of the switching device, all of the light emitting devices are removed from the circuit during charging of the accumulator. The disconnect device may consist of a manually operated switch or, where a mercury "switch" is employed as the switching device, the support box will be provided with a gradient and the switching device will be provided with a region containing no conductors corresponding to the position assumed by the mercury when the decorative article is positioned on the support box.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

Description of the Preferred Embodiment

Figure 1:
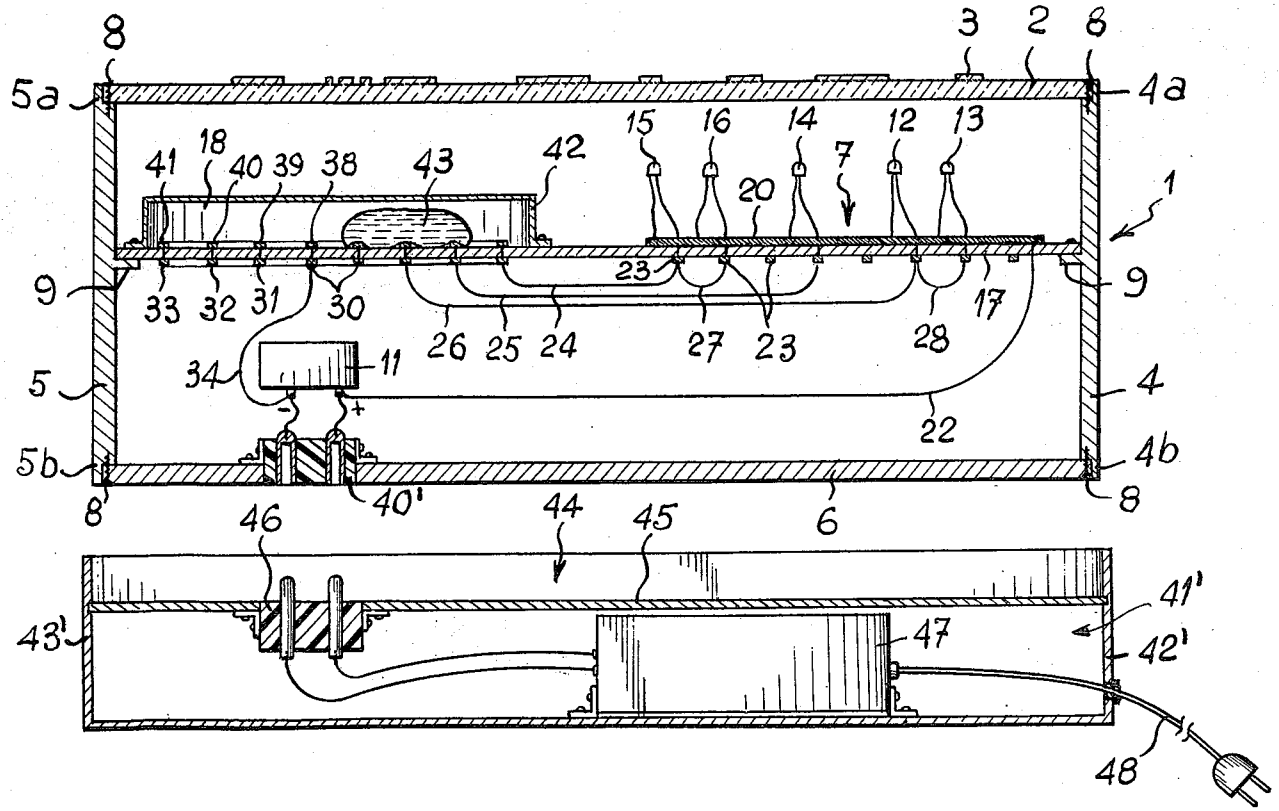
FIG. 1 is a cross-sectional schematic side elevation view, on a greatly enlarged scale, of a first embodiment of a decorative article in accordance with the present invention and a charging support for the article.

Referring to FIG. 1, a decorative device for use in or as an article of jewelry, for example a bracelet which has been omitted from the drawing in the interest of facilitating understanding of the invention, is indicated generally at 1. The device 1 comprises a housing of a flat parallel-epipedic shape. The housing will typically comprise an upper wall or cover member 2 which is either transparent or translucent. The cover member 2 may be provided, for example on its outer surface as shown, with decorative elements as indicated at 3.

The housing contains, as will be described in greater detail below, a plurality of electrically stimulated light sources which provide intermittent illumination for the decorative designs 3 provided on or in the cover member 2. It will, of course, be understood that the height of the housing of device 1 has been shown greatly exaggerated in the drawing and in actual practice the housing is of very thin construction.

Continuing to refer to FIG. 1, the housing includes, in addition to the cover member 2, oppositely disposed lateral walls 4 and 5 and a base member 6. Both cover member 2 and base member 6 are removable so as to permit the changing of the decorative design and also to permit service of the electrical circuit subassembly indicated generally at 7, positioned within the housing. To facilitate attachment and removal of the cover member and base, the walls 4 and 5 are provided, at the inside of their upper and lower edges, with shoulders **4*a*, 4*b*, 5*a* and 5*b* which receive and support the cover 2 and base 6 respectively. In the disclosed embodiment the cover member and base are shown as attached to the sidewalls of the housing by means of screws 8. The sidewalls 4 and 5 are also provided, on their interior surfaces, with a projection 9 which defines a shelf for supporting the printed circuit 10 which, in turn, supports the components of the electrical circuit 7**.

Figure 2:
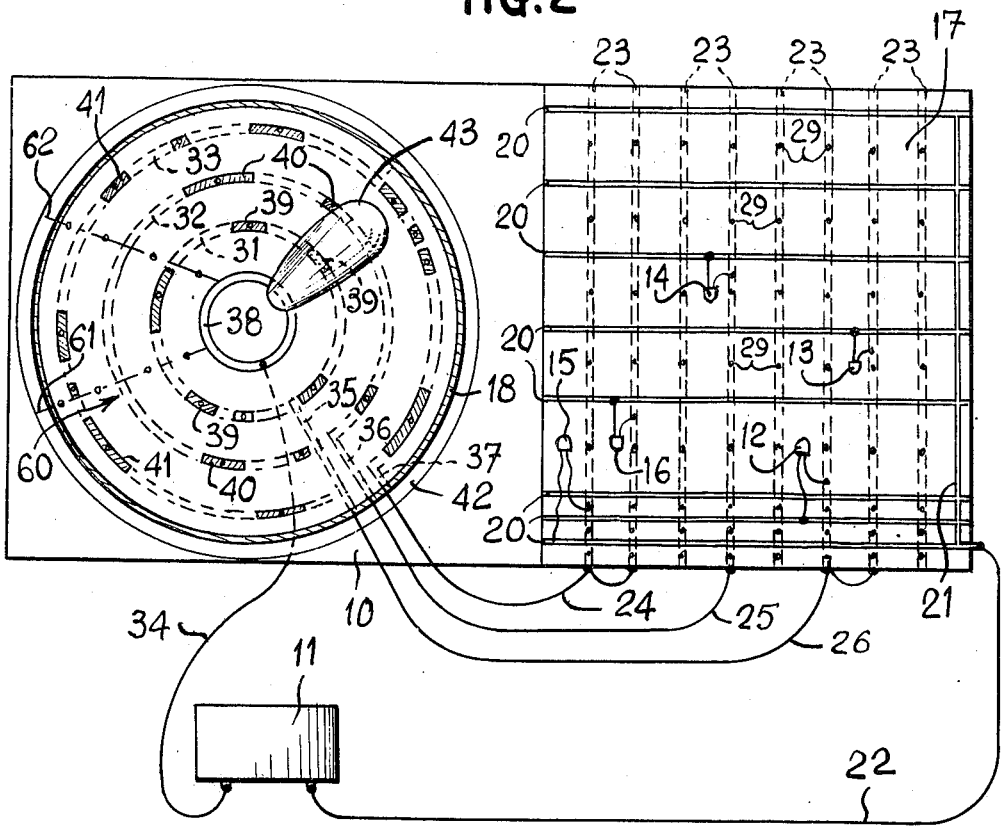
FIG. 2 is a top plan view of the circuit board of the embodiment of FIG. 1, FIG. 2 also showing the power source for the device.

Referring now to FIG. 2, the electric circuit 7 includes a current source 11. The current source 11 may consist of a battery or a rechargeable accumulator of very small size. The electrical circuit also comprises a plurality of light emitting devices, indicated as luminescent diodes 12, 13, 14, 15 and 16, a distribution or branching circuit 17 and a switching device 18. The switching device 18 is connected in series with the current source 11 and the distribution circuit 17. In the preferred embodiment of FIGS. 1 and 2 the circuit 17 and switch 18 are formed on a common substrate comprising a flexible printed circuit board; the board of printed circuit 10 having conductive paths on both sides thereof.

The circuit 17 consists of two groups of vertically displaced and electrically isolated parallel conductors; these conductors being formed on opposite sides of the printed circuit board. The conductors of the two groups define a lattice; i.e., the conductors of one group intersect vertical planes through the conductors of the other group. As shown in FIG. 2, parallel conductors 20 are formed on the upper side of the circuit board. The spacing between the conductors 20 may be varied or constant as desired and all of conductors 20 are interconnected by means of a common bus conductor 21. Bus conductor 21 is, in turn, connected by means of a wire 22 to a first potential terminal, preferably the positive terminal, of the current source 11. The conductors 23 on the bottom or lower side of board 10 are, in the disclosed embodiment, oriented transversely to the conductors 20 on the upper side of board 10. Conductors 23 are connected, for example by means of wires 24, 25 and 26, to respective terminals of the switching device 18. Some of the conductors 23 may also be connected to other parallel conductors on the same side of the circuit board by means of jumpers as shown at 27 and 28 in FIG. 1. The circuit board also contains through holes 29, positioned between the conductors 20, whereby connection may be made to the conductors 23 from the top of the board. Leads from the two terminals of each of the light emitting devices will respectively be soldered to one of the conductors 20 and, after being passed through one of the holes 29, to one of the conductors 23. The network of conductors 20 and 23 permits the light emitting devices to be distributed on the upper side of board 10 with a great deal of flexibility and thus in accordance with the desires or "program" of the creator of the decorative design 3 on the cover member 2 of the housing.

The switching device 18, in the disclosed embodiment, is in part defined by four concentric substantially ring-shaped conductors 30, 31, 32 and 33 formed on the lower side of the printed circuit board. These concentric conductive rings are indicated by broken lines on FIG. 2 and conductor 30 is not seen in FIG. 2 since it lies directly below a conductor 38 on the upper side of board 10. The central conductor 30 is connected, by means of a wire 34, to the second or negative terminal of current source 11. The ring-shaped conductors 31, 32 and 33 will typically each include a gap which affords a space for radial conductors 35, 36 and 37. Radial conductors 35, 36 and 37 respectively connect annular conductors 31, 32 and 33 to terminals on the lower side of the printed circuit board. The second ends of wires 24, 25 and 26 are connected to these terminals thus establishing electrical connection between the switching device 18 and the branching circuit 17. On the upper surface of the printed circuit board the switching device includes the ring-shaped conductor 38 which is, by any suitable means and preferably by a through hole connector, electrically connected to the conductor 30. Conductor segments, as indicated at 39, 40 and 41, are formed on board 10 in vertical alignment with the ring-shaped conductors on the lower side of the circuit board. Connection between these conductor segments and the underlying ring-shaped conductors is accomplished by means of through hole connectors of a type standard in the printed circuit arts. As may best be seen from FIG. 1, the switching device 18 is completed by means of a cover member 42 which will typically be of flat cylindrical shape. The cover 42 is hermetically attached by any suitable means to the surface of the printed circuit board. A charge of liquid mercury 43 is positioned within cover 42 so as to be in contact with the conductor 38; mercury mass 43 having the capability of contacting one or more of the segmented conductors 39, 40 and 41. Restated, the mercury 43, which is equivalent to a switch wiper arm, is free to move as an integral unit over the surface of the printed circuit board within the confines of cover 42.

In accordance with a preferred embodiment the current source 11 comprises a rechargeable accumulator. The terminals of accumulator 11 are electrically connected to corresponding terminals of a receptacle 40' mounted in the base 6 of housing 1. The invention may also comprise a support, indicated generally at 41', having lateral walls 42' and 43' which cooperate with a base member 45 to define a recess or well 44 which receives the article 1. The member 45 is provided with a plug member 46 including a pair of upwardly extending conductors which, when article 1 is positioned on the support, are engaged in the connectors of receptacle 40'. The prongs of plug 46 are connected to a source of charging current 47 which may, in turn, be connected to a suitable alternating current source by means of line cord 48. The source of charging current 47 may consist merely of a battery or a standard battery charger.

Figure 3:
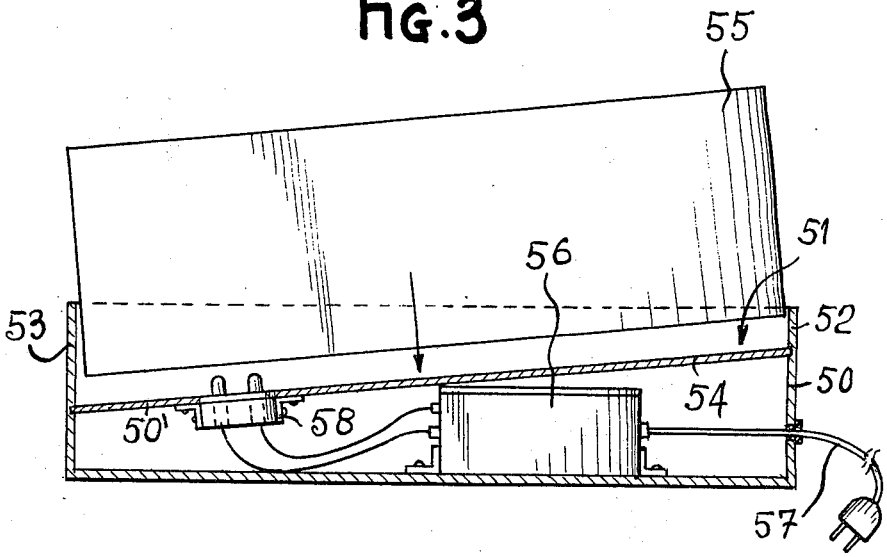
FIG. 3 is a side elevation view, partly in section, of a second embodiment of the invention, FIG. 3 particularly illustrating a supporting and recharging accessory for a decorative article including the invention.

In the interest of avoiding consumption of electrical power when article 1 is mounted on support 41', the invention may be provided with means for interrupting the connection between the accumulator 11 and conductor 30 on the printed circuit board. This disconnect means may comprise merely a manually operated switch or it may consist of interlock means connected in series with wire 34 which will interrupt the current path automatically when the article 1 is situated on the support 41'. Preferably, however, the means for electrically disconnecting the light emitting devices from the power source when the article is not in use and thus situated on the support will take the form depicted in FIG. 3. In FIG. 3 the support 50, comprised of lateral walls 52 and 53, defines a recess or well 51 for receiving and supporting the decorative article 55 on an angle. As in the case of FIG. 1 embodiment, the support 50 of FIG. 3 includes a male plug 58 extending from base member 50', a source of charging current 56 and a line cord 57 whereby the charging current source may be connected to a source of alternating current. Since the article supporting base member 50' of the support member 50 of FIG. 3 is inclined with respect to the horizontal, the mercury wiper arm of the switching device 18 will move so as to lie within the sector 60 of the printed circuit when the decorative article is placed in the support. The sector 60 of the printed circuit portion of the switching device will not contain any conductor segments and, accordingly, there will be no connection established between accumulator 80 and the branching circuit 17 when the article is on the FIG. 3 type support.

When carried by a person the decorative article of the present invention will have its mercury mass moved and deformed as a function of the inclination of the printed circuit board with respect to the horizontal. The angle of inclination is, of course, continuously varied as a result of movements of the body of the person carrying the article. Thus, the light emitting devices 12–16 are irregularly energized, uniquely as a function of the movements of the person, and attractive and complex effects are obtained. In actual practice an article in accordance with the present invention may contain dozens of luminescent diodes and the switching device 18 a corresponding number of separate conductors.

When the article is placed in the support of FIG. 3, the plug on the support and the receptacle on the articles are automatically engaged and the accumulator 11 is thus connected to the output side of the charging current source 56. Because of the incline of the base 50' of the support device, the mass of mercury runs into the free sector 60, as defined by the broken lines 61 and 62 of FIG. 2, and connection between the accumulator and diodes is thus prevented.

While a preferred embodiment has been shown and described, various modifications and substitutions may be made thereto without departing from the spirit and scope of the invention. Thus, by way of example, the printed circuit board may be mounted within the interior of the body of a piece of jewelry; the jewelry containing apertures or transparent portions which are aligned with the light emitting devices. Also, the cover 42 of the switching device 18 may include an intermediary wall which separates a switch into two concentric chambers each including a mercury wiper arm. Such an arrangement permits an even more diverse lighting pattern to be generated. Thus, it will be seen that the present invention has been described by way of illustration and not limitation.

What is claimed is:

1. Apparatus for generating a varying lighted display comprising:

a plurality of electrically energized light emitting devices;

means for supporting said light emitting devices in an array, said supporting means being adapted to be received within an article of jewelry;

a source of electric current; and a distributor switch for controlling the delivery of current from said source to said light emitting devices, said switch having an active area of generally annular shape, said switch further having an annular electrode connected to a first polarity terminal of said source and a plurality of arcuate shaped segmental electrodes respectively connected to preselected of said light emitting devices, the spaces between said annular electrode and said segmented electrodes being bridgeable by a freely movable conductor whereby said distributor switch operates in response to the attitude of the apparatus to establish and interrupt a plurality of circuits between said source and light emitting devices for energization of said light emitting devices either singly or in groups.

2. The apparatus of claim 1 wherein said distributor switch freely movable conductor comprises:

a mass of mercury.

3. The apparatus of claim 1 wherein said supporting means comprises:

a printed circuit board, said board having conductors on both sides thereof, said conductors defining an intersecting pattern, the conductors on a first side of said board being all connected to a second polarity terminal of said source, the conductors on the second side of said board being connected to preselected of said distributor switch segmental electrodes, said board being provided with apertures whereby each of said light emitting devices may be connected to a conductor on each side of said board.

4. The apparatus of claim 2 wherein said supporting means comprises:

a printed circuit board, said board having conductors on both sides thereof, said conductors defining an intersecting pattern, the conductors on a first side of said board being all connected to a second polarity terminal of said source, the conductors on the second side of said board being connected to preselected of said distributor switch segmental electrodes, said board being provided with apertures whereby each of said light emitting devices may be connected to a conductor on each side of said board.

5. The apparatus of claim 4 further comprising:

a housing for said light emitting devices, supporting means, current source and switch means, said housing having a cover member through which the light generated by said devices will be visible.

6. The apparatus of claim 5 wherein said housing cover member includes a design which is randomly illuminated by light generated by said devices.

7. The apparatus of claim 1 further comprising:

a housing for said light emitting devices, supporting means, current source and switch means, said housing having a cover member through which the light generated by said devices will be visible.

8. The apparatus of claim 7 wherein said housing cover member includes a design which is randomly illuminated by light generated by said devices.

9. Apparatus for generating a varying lighted display comprising:

a plurality of electrically energized light emitting devices;

means for supporting said light emitting devices in an array, said supporting means being adapted to be received within an article of jewelry;

rechargeable battery means, said battery means including a battery and a receptacle whereby charging current may be delivered to said battery;

switch means for controlling the delivery of current from said battery to said light emitting devices, said switch means having a plurality of output terminals and operating in response to the attitude of the apparatus to establish and interrupt a plurality of circuits between said battery and devices whereby said devices may be energized singly or in groups; and means for charging said battery means, said charging means including a source of charging current and a stand for said apparatus, said stand supporting said apparatus in an attitude which causes said switch means to interrupt the circuits to all of said light emitting devices, said charging means including an output connector which engages said battery means receptacle.

10. The apparatus for claim 9 wherein said switch means comprises:

a distributor switch, said switch having an active area of generally annular shape, said switch further having an annular electrode connected to a first polarity terminal of said battery and a plurality of arcuate shaped segmental electrodes respectively connected to preselected of said light emitting devices, the spaces between said annular electrode and said segmented electrodes being bridgeable by a freely movable conductor.

11. The apparatus of claim 10 wherein said movable conductor comprises:

a mass of mercury.

* * * * *